US008517362B1

(12) United States Patent
Pittman

(10) Patent No.: US 8,517,362 B1
(45) Date of Patent: Aug. 27, 2013

(54) FLETCHING JIG AND METHOD FOR FLETCHING AN ARROW

(71) Applicant: Leon Monroe Pittman, Pendergrass, GA (US)

(72) Inventor: Leon Monroe Pittman, Pendergrass, GA (US)

( * ) Notice: Subject to any disclaimer, the term of this patent is extended or adjusted under 35 U.S.C. 154(b) by 0 days.

(21) Appl. No.: 13/744,762

(22) Filed: Jan. 18, 2013

Related U.S. Application Data

(60) Provisional application No. 61/686,188, filed on Apr. 2, 2012.

(51) Int. Cl.
*B25B 11/00* (2006.01)

(52) U.S. Cl.
USPC ..... 269/38; 269/231; 269/236; 29/270

(58) Field of Classification Search
USPC ..... 269/38, 37, 6, 3, 95, 45, 43, 143, 269/231, 236; 29/255, 270.278, 244
See application file for complete search history.

(56) References Cited

U.S. PATENT DOCUMENTS

| | | | | |
|---|---|---|---|---|
| 2,468,358 | A * | 4/1949 | Clark | 408/95 |
| 3,015,483 | A * | 1/1962 | Martin | 269/38 |
| 3,051,124 | A * | 8/1962 | Schlensker et al. | 118/503 |
| 4,749,175 | A | 6/1988 | Grabits | |
| 5,092,572 | A * | 3/1992 | Litwak et al. | 5/600 |
| 5,211,382 | A * | 5/1993 | Finlay | 269/38 |
| 5,816,568 | A * | 10/1998 | Fox | 269/60 |
| 6,206,355 | B1 * | 3/2001 | Lichtenberg | 269/156 |
| 7,422,202 | B2 * | 9/2008 | Wu | 269/303 |
| 7,485,057 | B2 * | 2/2009 | Afshari | 473/586 |
| 8,286,953 | B2 * | 10/2012 | Barnes et al. | 269/38 |

OTHER PUBLICATIONS

Bitzenburger Fletching Jig, downloaded from: keystonecountrystore.com/Bitzenburger_Fletching_Jig.html on Jan. 17, 2013.

* cited by examiner

*Primary Examiner* — Lee D Wilson
(74) *Attorney, Agent, or Firm* — Mitch Harris, Atty at Law, LLC; Andrew Mitch Harris

(57) ABSTRACT

An arrow fletching jig provides operation that adapts to various arrow shaft diameters and arrow fletching patterns. The fletching jig includes a clamp secured to a base. The clamp secures a fletch at a fixed orientation along the arrow shaft while the fletch is being glued to the arrow shaft. The clamp can be made rotatable to tilt the clamp with respect to the arrow shaft, so that the fletch forms a helicoid around the shaft. The clamp may provide semi-cylindrical notches at each end to maintain spacing of arrow shaft and clamp by contacting the arrow shaft along an inner surface of the semi-cylindrical notches when an end of the clamp is rotated around the shaft to tilt the clamp. The fletching jig may also include a notched arrow shaft clamp for securing the arrow shaft to the base, which is rotated to secure and release the arrow.

26 Claims, 5 Drawing Sheets

FLETCHING JIG AND METHOD FOR FLETCHING AN ARROW

This U.S. Patent Application claims priority under 35 U.S.C. §119 to U.S. Provisional Patent Application Ser. No. 61/686,188 filed on Apr. 2, 2012.

BACKGROUND OF THE INVENTION

1. Field of the Invention

The present invention relates generally to equipment for constructing and servicing arrows for archery, and more particularly, to a fletching jig that secures an archery arrow while gluing one or more fletches to the arrow.

2. Description of the Related Art

The fabrication and repair of archery arrows requires attachment of fletches or feathers behind the crest of the shaft.

Typically, three or four fletches are glued to the shaft at even angular displacements around the circumference of the shaft, and the fletches may be disposed parallel to the axis of the shaft, or may spiral around the shaft. The fletches must be held in place while the glue sets, or the fletch might move before the glue has set.

For the purpose of gluing fletches, several fletching jigs are available for holding fletches to the shaft of the arrow. However, the fletching jigs are either specifically set for particular numbers of fletch, types of fletch positioning and/or shaft diameters, or the adjustments required are unwieldy and time-consuming when servicing or building a variety of arrows having different fletching patterns or shaft diameters.

Therefore, it would be desirable to provide a fletching jig that can easily or automatically adapt to various fletching patterns and arrow shaft diameters.

SUMMARY OF THE INVENTION

The objective of providing a fletching jig that can easily or automatically adapt to various fletching patterns and arrow shaft diameters is provided in a fletching jig and its method of operation.

The fletching jig includes a clamp for removably securing the fletch in a settable position with respect to the arrow shaft and a base for securing the arrow shaft. The clamp includes a pair of flexible rods for securing the fletch while the fletch, which is secured between the flexible rods, is glued to the arrow shaft. The clamp may be movably coupled to the base and is rotatable with respect to the arrow shaft. The clamp can thus be tilted to position the fletch to form a helicoid around the shaft. The clamp may include a pair of semi-cylindrical notches at respective ends of the clamp to maintain a distance between the arrow shaft and the clamp by contacting the arrow shaft along an inner surface of the semi-cylindrical notches when an end of the clamp is rotated around the shaft to tilt the clamp.

The fletching jig may also include a notched rotating shaft clamp for securing the arrow shaft to the base, which may be rotated to release the arrow and secured with elastic to retain v-shaped notches of the rotating clamp around the arrow shaft, allowing shafts of different diameters to be secured in the fletching jig. The fletching jig may also include a nock rotator for rotating the arrow when preparing to glue another fletch at another rotation around the arrow.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention includes fletching jigs for constructing and servicing archery arrows. The fletching jig illustrated herein provides a repeatable and adaptable fletching process, with a jig that is easy to set up and use.

Figure 1A:
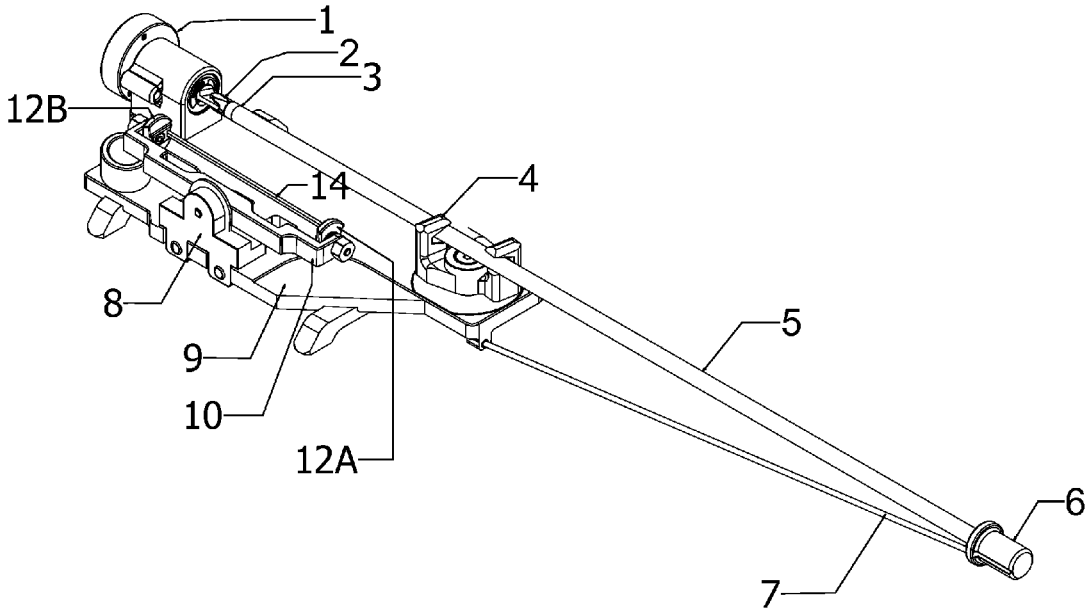
FIG. 1A is an isometric view and FIG. 1B is a top view of a fletching jig in accordance with an embodiment of the invention.

Referring now to FIG. 1A, a fletching jig in accordance with an embodiment of the invention is illustrated with an arrow 5 inserted in the fletching jig. In the illustration, arrow 5 is secured by a rotating clamp 4 that has a pair of v-shaped notches 11 which, when rotating clamp 4 is rotated by a spring or other restoring-force device, sit securely against the shaft of arrow 5, preventing movement. Rotating clamp 4 can be rotated by hand to readily release arrow 5 by moving notches 11 away from the shaft of arrow 5, e.g., by rotation of rotating clamp 4 one-quarter turn. At the opposite end of a base 9, to which rotating clamp 4 is secured, a nock rotator 2 receives the nock 3 of arrow 5, and a dial 1 is provided to rotate arrow 5 to position the shaft of arrow 5 for gluing fletches (not shown) at various angles around the circumference of the shaft of arrow 5. At the tip of arrow 5, a cap 6 is provided to secure nock 3 to nock rotator 2 using an elastic band 7 that pulls cap 6 toward base 9.

A fletch is retained in position while the fletch is glued to arrow by a fixture that includes an arm 10 that rotates about a pivot pin 8 in an axis perpendicular to the axis of the arrow 5 so that the fletch can be positioned at an angle to the arrow 5 shaft and follow a helical path along the surface of arrow 5, so that after gluing the fletch forms a helicoid. A pair of rods 14, with ends set into a pair of cams 12A and 12B, are used to secure the fletch. Cams 12A and 12B are each rotatably secured to arm 10 by a pivot, so that cams 12A and 12B can independently rotate with respect to an axis perpendicular to the rotational axis of arm about pivot pin 8.

Rods 14 are parallel, set close together and have sufficient flexibility to permit insertion and removal of the fletch without damaging the fletch, but so that the fletch is stably secured during the gluing process. Cams 12A and 12B each define a cylindrical notch that rests against the shaft of arrow 5, so that when cam 12A or cam 12B is rotated, the angle of the helix followed by the fletch can be set and maintained during the gluing. Cam 12A and 12B have a degree of friction with respect to their rotation, or a locking means can be provided such as a set screw, so that cams 12A and 12B will not turn during the gluing process unless manipulated to do so by the operator. After the glue for the fletch is set, nock rotator dial 1 can be moved to the next angular position around arrow 5 and the next fletch glued in place.

Figure 1B:
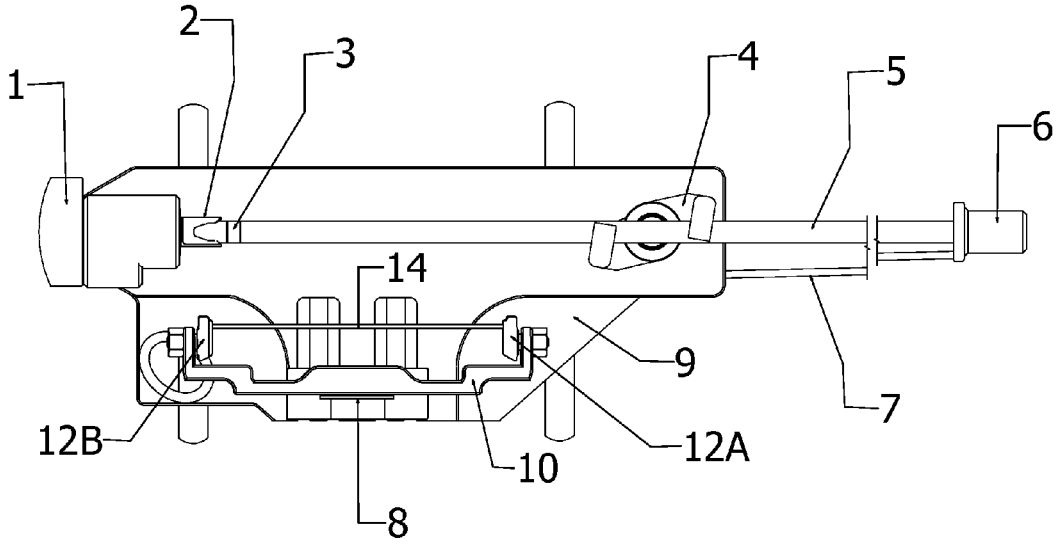

Referring now to FIG. 1B, a top view of the fletching jig of FIG. 1A is shown. The rotating feature of arrow shaft clamp 4 is illustrated, such that if arrow shaft clamp 4 is rotated counter-clockwise in the Figure, the notched arms of arrow shaft clamp 4 will no longer contact the shaft of arrow 5 and arrow 5 can be removed from the fletching jig. The shaft of arrow 5 is shortened in FIG. 1B, for clarity. The relationship of rods 14 to arrow 5 and arm 10 can be seen, in particular, that rods 14 are disposed in a plane perpendicular to the central axis of arrow 5 and are rotated in that plane as arm 10 is rotated around pivot pin 8, so that the angle of the helicoid formed by the fletch around the shaft of arrow 5 can be varied until the desired angle of the fletch is achieved.

Figure 2:
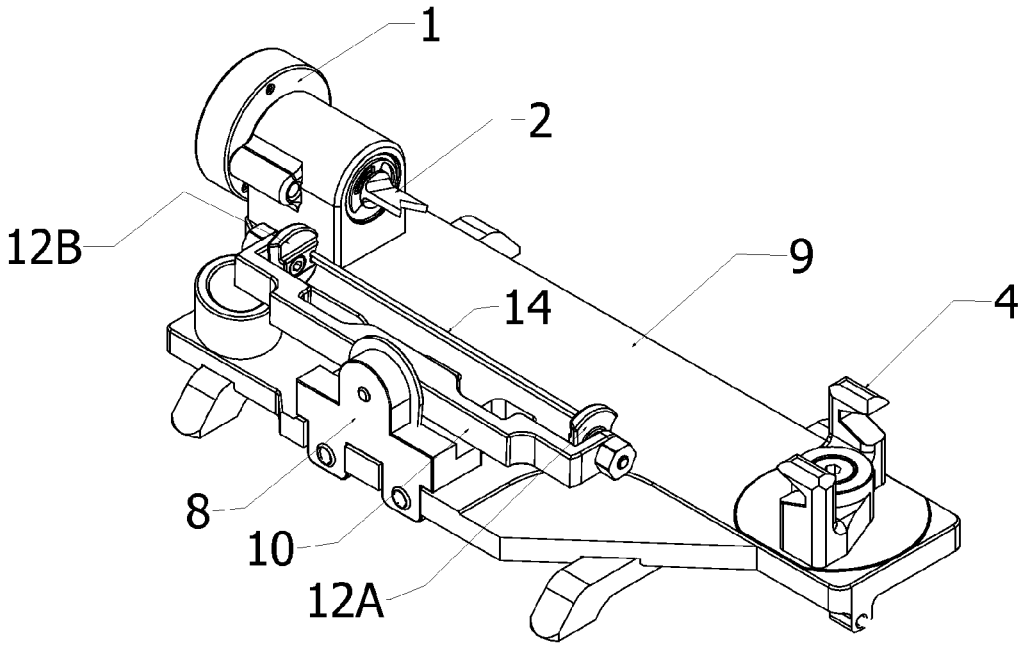
FIG. 2 is an isometric view of the fletching jig of FIGS. 1A and 1B, showing further detail.

Referring now to FIG. 2, an isometric view of the fletching jig of FIGS. 1A-1B is illustrated. Details of nock rotator 2 can be seen since arrow 5 is removed in the Figure, and arrow shaft clamp 4 is shown in the open (non-clamping) position.

Figure 3:
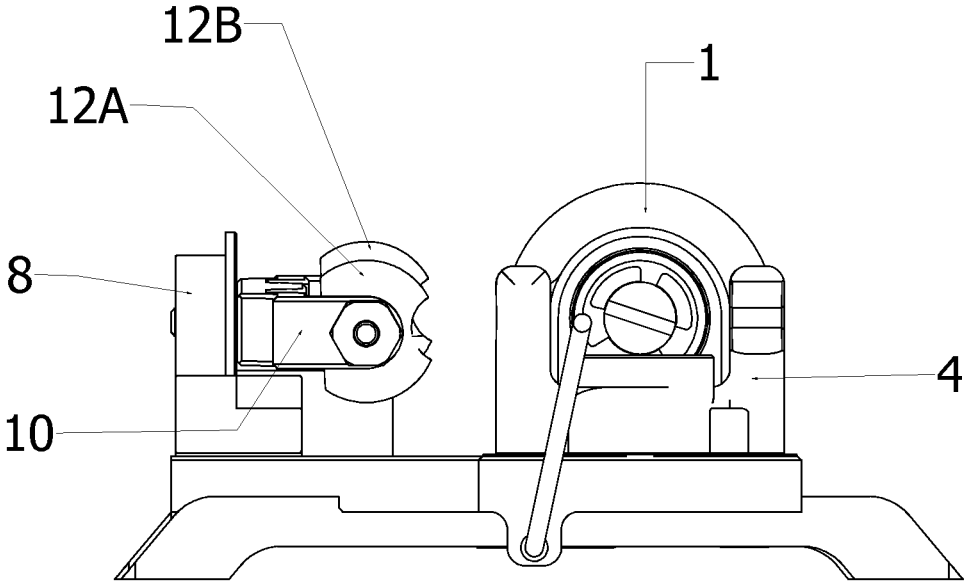
FIG. 3 is an end view of the fletching jig of FIGS. 1A and 1B, showing further detail.

Referring now to FIG. 3, an end view of the fletching jig of FIGS. 1A-1B is illustrated. Details of cams 12A, 12B, can be seen, specifically the notches that contact the arrow shaft and the end of arm 10 through which the axle that secures cams 12A, 12B to arm 10 is secured with a nut.

Figure 4:
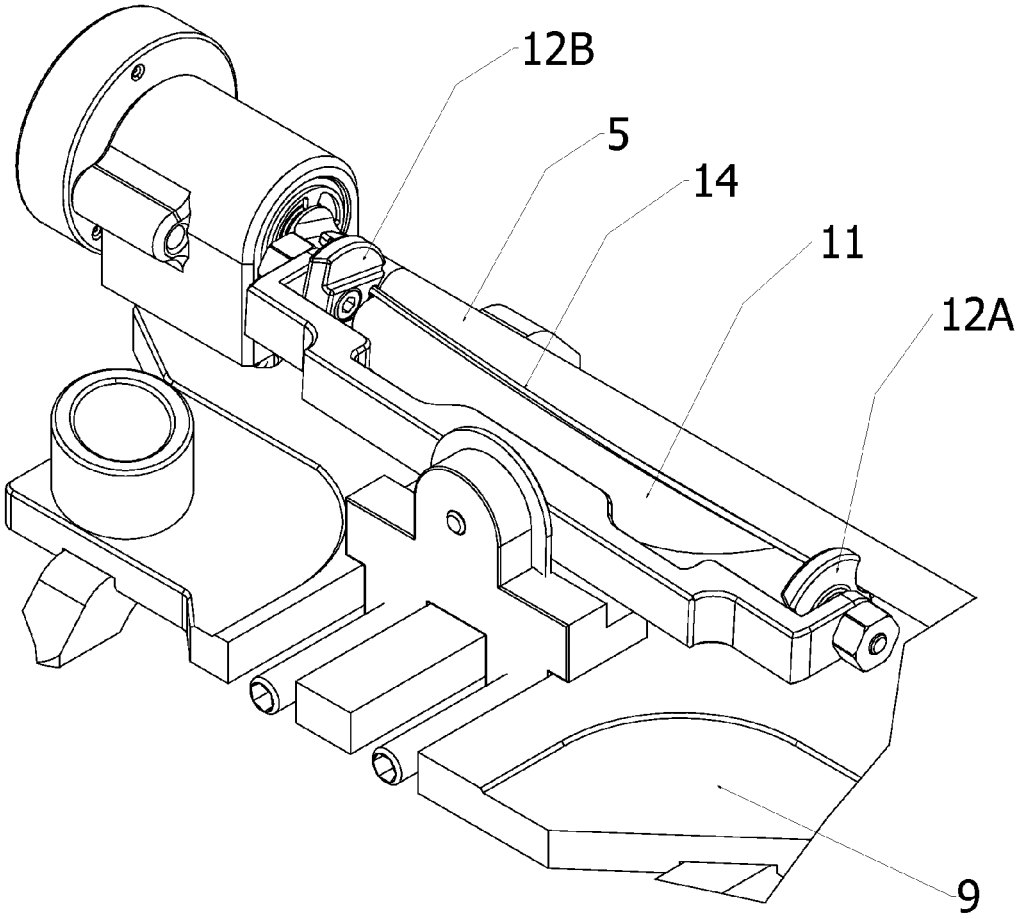
FIG. 4 is an isometric view of the fletching jig of FIGS. 1A and 1B, showing further detail.

Referring now to FIG. 4, an isometric view of the fletching jig of FIGS. 1A-1B is illustrated. Cams 12A, 12B are shown contacting the shaft of arrow 5 while a fletch 11 is held against the shaft of arrow 5 during the gluing process.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A fletching jig for securing a fletch to an archery arrow during gluing of the fletch to an arrow shaft of the archery arrow, the fletching jig comprising:

a fletch clamp for removably securing the fletch in a settable position with respect to an arrow shaft of the archery arrow, wherein the fletch clamp comprises a pair of flexible rods and a pair of cams at which the flexible rods are secured at ends of the flexible rods, wherein the flexible rods are disposed adjacent to each other for removably securing the fletch, and wherein the cams have a cam surface including a recessed notch within the cam surface for contacting the arrow shaft; and a base for securing the arrow shaft, wherein the fletch clamp is coupled to the base such that the fletch clamp is secured in a predetermined position with respect to the arrow shaft when the archery arrow is mounted in the fletching jig.

2. The fletching jig of claim 1, wherein the fletch clamp is movably coupled to the base such that the fletch clamp is rotatable about a first axis extending radially from the arrow shaft when the arrow is mounted in the fletching jig, so that the fletch clamp can be tilted with respect to a second axis extending along and parallel to the shaft to position the fletch to form a helicoid around the shaft.

3. The fletching jig of claim 2, wherein the cams are disposed at respective ends of the fletch clamp, and wherein the recessed notches of the cams are semi-cylindrical notches disposed toward the arrow shaft when the arrow is mounted in the fletching jig to maintain a distance between the arrow shaft and the fletch clamp by contacting the arrow shaft along an inner surface of the semi-cylindrical notches when an end of the fletch clamp is rotated around the shaft to tilt the fletch clamp.

4. The fletching jig of claim 3, wherein the fletch clamp comprises an arm rotatably coupled to the base, wherein the arm rotates around the first axis.

5. The fletching jig of claim 4, wherein the pair of flexible rods extend between faces of the cams, wherein the flexible rods flex to permit the fletch to adjust a pitch of the helicoid when one of the cams rotates around the shaft when the arm is rotated around the first axis.

6. The fletching jig of claim 4, further comprising a registration mechanism formed between the arm and the base, whereby the pitch can be set to one of multiple predetermined pitches.

7. The fletching jig of claim 1, wherein the base further comprises an arrow shaft clamp for securing the arrow shaft to the base.

8. The fletching jig of claim 7, wherein the arrow shaft clamp is rotatably coupled to the base, wherein the arrow shaft clamp defines a pair of securing notches for contacting opposite sides of the shaft when the archery arrow is mounted in the fletching jig to secure the arrow shaft during the gluing, wherein the arrow shaft clamp rotates to move the pair of securing notches away from the opposite sides of the shaft to release the arrow shaft.

9. The fletching jig of claim 8, wherein the securing notches have a width that progressively decreases from an outer edge of the securing notches toward a body of the arrow shaft clamp, whereby archery arrows having different shaft diameters can be secured in the fletching jig.

10. The fletching jig of claim 1, further comprising a nock rotator affixed to the base, wherein the nock rotator includes a dial for rotating a nock of the arrow, whereby the shaft of the arrow is rotated to position different fletches for gluing to the archery arrow.

11. The fletching jig of claim 10, further comprising a tip cap for securing the archery arrow to the nock rotator, wherein the tip cap is mechanically coupled to the base by an elastic cord.

12. A method for securing a fletch to an archery arrow during gluing of the fletch to an arrow shaft of the archery arrow, the method comprising:

securing the arrow shaft in a base; and removably securing the fletch in a settable position with respect to the arrow shaft by securing the fletching between flexible rods of a fletch clamp of a fletching jig coupled to the base, wherein the flexible rods are secured at their ends to a pair of cams of the fletch clamp, wherein the cams have a cam surface including a recessed notch within the cam surface for contacting the arrow shaft.

13. The method of claim 12, further comprising rotating the fletch clamp, with respect to a base to which the fletch clamp is rotatably coupled, about a first axis extending radially from the arrow shaft when the archery arrow is mounted in the fletching jig, to tilt the fletch clamp with respect to a second axis extending along and parallel to the shaft to position the fletch to form a helicoid around the shaft, and wherein the flexible rods flex to permit adjustment of a pitch of the helicoid via the rotating.

14. The method of claim 13, wherein the recessed notch of the pair of cams are semi-cylindrical notches and further comprising maintaining a distance between the arrow shaft and the fletch clamp by contacting the arrow shaft along an inner surface at the semi-cylindrical notches when an end of the fletch clamp is rotated around the shaft to tilt the fletch clamp.

15. The method of claim 14, wherein the rotating rotates an arm rotatably coupled to the base, wherein the arm rotates around the first axis.

16. The method fletching jig of claim 15, wherein the rotating rotates the arm to one of multiple predetermined pitches via a registration mechanism formed between the arm and the base.

17. The method of claim 12, further comprising securing the arrow shaft to the base using an arrow shaft clamp.

18. The method of claim 17, wherein the securing the arrow shaft secures the arrow shaft to the base by rotation of a cam rotatably coupled to the base, wherein the cam defines a pair of securing notches for contacting opposite sides of the shaft when the arrow is mounted in the fletching jig to secure the shaft during the gluing, and wherein a restoring spring provides for the rotation of the cam to secure the arrow shaft, and wherein the method further comprises releasing the arrow shaft by rotating the cam to move the pair of securing notches away from the opposite sides of the arrow shaft to release the arrow shaft.

19. The method of claim 18, wherein the securing notches have a width that progressively decreases from an outer edge of the notch toward a body of the cam, whereby archery arrows having different shaft diameters can be secured by the securing.

20. The method of claim 12, further comprising rotating a nock of the archery arrow using a nock rotator affixed to the base, whereby the arrow shaft is rotated to position different fletches for gluing to the arrow shaft.

21. The method of claim 20, further comprising securing the arrow to the nock rotator by fitting a cap over a tip of the archery arrow, wherein the cap is mechanically coupled to the base by an elastic cord.

22. A fletching jig for securing a fletch to an archery arrow during gluing of the fletch to an arrow shaft of the archery arrow, the fletching jig comprising:

a base for supporting the fletching jig;

a fletch clamp for removably securing the fletch in a settable position with respect to the arrow shaft, wherein the fletch clamp comprises an arm having one of a pair of cams rotatably affixed to a corresponding end thereof and a pair of flexible rods extending between the cams for securing the fletch between the rods, wherein the cams each define a semi-cylindrical notch for contacting the shaft of the arrow as one or both of the cams is rotated when the arm is tilted with respect to the shaft, wherein the arm is rotatably coupled to the base about a first axis extending radially from a shaft of the arrow when the archery arrow is mounted in the fletching jig, so that the fletch clamp can be tilted with respect to a second axis extending along and parallel to the shaft to position the fletch to form a helicoid around the arrow shaft;

an arrow shaft clamp rotatably coupled to the base, wherein the arrow shaft clamp defines a pair of securing notches for contacting opposite sides of the shaft when the arrow is mounted in the fletching jig to secure the shaft during the gluing, and wherein a restoring spring provides for the rotation of the arrow shaft clamp to secure the arrow;

a nock rotator affixed to the base, wherein the nock rotator includes a dial for rotating a nock of the archery arrow, whereby the arrow shaft is rotated to position different fletches for gluing to the arrow shaft; and a tip cap for securing the arrow to the nock rotator, wherein the tip cap is mechanically coupled to the base by an elastic cord.

23. A fixture for securing an archery arrow during fabrication or maintenance, the fixture comprising:

a base for stabilizing the archery arrow during the fabrication or maintenance;

an arrow shaft clamp coupled to the base for securing a shaft of the arrow to the base, wherein the arrow shaft clamp is rotatably coupled to the base, wherein the arrow shaft clamp defines a pair of securing notches for contacting opposite sides of the shaft when the arrow is mounted in the fletching jig to secure the shaft during the fabrication or maintenance, wherein the arrow shaft clamp rotates to move the pair of securing notches away from the opposite sides of the arrow shaft to release the archery arrow;

a retaining element disposed on the base and longitudinally aligned with the arrow shaft clamp; and a clamp having flexible elements disposed adjacent to the retaining element and the arrow shaft clamp.

24. The fixture of claim 23, wherein the securing notches have a width that progressively decreases from an outer edge of the securing notches toward a body of the arrow shaft clamp, whereby arrows having different shaft diameters can be secured in the fletching jig.

25. A method of securing an archery arrow during fabrication or maintenance, the method comprising:

stabilizing the archery arrow during the fabrication or maintenance with a base;

securing an arrow shaft of the arrow to the base using an arrow shaft clamp comprising a cam rotatably coupled to the base, wherein the cam defines a pair of securing notches for contacting opposite sides of the shaft when the arrow is mounted in the fletching jig to secure the shaft during the fabrication or maintenance, and wherein a restoring spring provides for the rotation of the cam to secure the arrow shaft;

releasing the arrow shaft by rotating the cam to move the pair of securing notches away from the opposite sides of the arrow shaft to release the arrow shaft;

securing an end of the arrow with a retaining element disposed on the base and longitudinally aligned with the arrow shaft clamp; and providing a clamp having flexible elements disposed adjacent to the retaining element and the arrow shaft clamp for performing the fabrication or maintenance.

26. The method of claim 25, wherein the securing notches have a width that progressively decreases from an outer edge of the notch toward a body of the cam, whereby archery arrows having different shaft diameters can be secured by the securing.

* * * * *